US008130596B2

(12) United States Patent
Godat

(10) Patent No.: US 8,130,596 B2
(45) Date of Patent: Mar. 6, 2012

(54) ELECTRONIC CIRCUIT CONTROLLING THE OPERATION OF PERIPHERAL MEMBERS OF THE WATCH

(75) Inventor: Yves Godat, Cornaux (CH)

(73) Assignee: EM Microelectronic-Marin S.A., Marin (CH)

( * ) Notice: Subject to any disclaimer, the term of this patent is extended or adjusted under 35 U.S.C. 154(b) by 746 days.

(21) Appl. No.: 12/324,371

(22) Filed: Nov. 26, 2008

(65) Prior Publication Data

US 2009/0135678 A1 May 28, 2009

(30) Foreign Application Priority Data

Nov. 26, 2007 (EP) ..... 07121548

(51) Int. Cl.
*G04F 5/00* (2006.01)
*G04C 3/00* (2006.01)

(52) U.S. Cl. ..... 368/156; 368/204

(58) Field of Classification Search ..... 368/10, 368/64, 66, 80, 155, 156, 203, 204; 713/320, 713/323, 324
See application file for complete search history.

(56) References Cited

U.S. PATENT DOCUMENTS 4,041,691 A * 8/1977 Chihara et al. ..... 368/66
4,219,999 A * 9/1980 Ichikawa et al. ..... 368/66
4,690,568 A * 9/1987 Odagiri et al. ..... 368/204
4,841,440 A * 6/1989 Yonezu et al. ..... 713/322
5,289,452 A 2/1994 Sakamoto et al.
5,633,573 A * 5/1997 van Phuoc et al. ..... 320/128
5,995,820 A * 11/1999 Young et al. ..... 455/343.1
6,061,304 A * 5/2000 Nagata et al. ..... 368/66
6,144,621 A * 11/2000 Sase ..... 368/204
6,580,665 B1 * 6/2003 Kamiyama et al. ..... 368/66
6,816,439 B1 * 11/2004 Kawahara et al. ..... 368/64
7,000,140 B2 * 2/2006 Okubo et al. ..... 713/601
7,072,080 B1 7/2006 Yamamoto
2003/0145242 A1 * 7/2003 Derocher et al. ..... 713/320
2004/0100870 A1 * 5/2004 Igarashi et al. ..... 368/66
2006/0285442 A1 12/2006 Maeder

FOREIGN PATENT DOCUMENTS

JP 4-316114 11/1992

OTHER PUBLICATIONS

European search report issued in corresponding application No. EP 07 12 1548, completed Mar. 3, 2008.

* cited by examiner

*Primary Examiner* — Vit Miska
(74) *Attorney, Agent, or Firm* — Griffin & Szipl, P.C.

(57) ABSTRACT

The electronic circuit (1) controls the operation of the peripheral members of a watch. The circuit (1) includes a processor (2) connected to a non-volatile memory (3), which contains instructions to be carried out, peripheral member controllers (4) for interacting with peripheral members of the watch and connecting means (6*a*, 6*b*, 7). These connecting means (6*a*, 6*b*, 7) are arranged to enable the peripheral member controllers (4), the non-volatile memory and the processor (2) to communicate data relating to the operation of said watch to each other. This electronic circuit (1) further includes initializing means (8) able to act on the peripheral member controllers (4) to initialize said controllers so that they can execute operations independently of the processor (2) and/or the non-volatile memory (3).

14 Claims, 1 Drawing Sheet

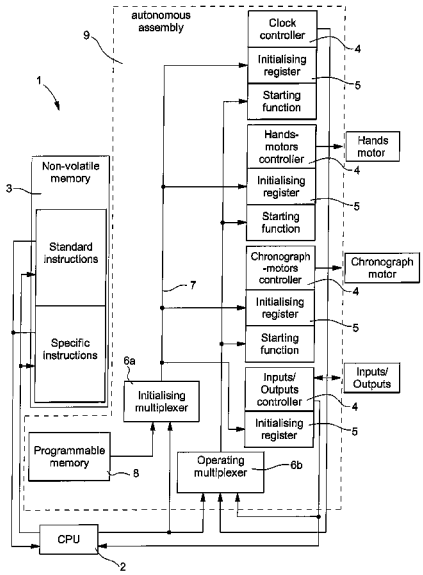

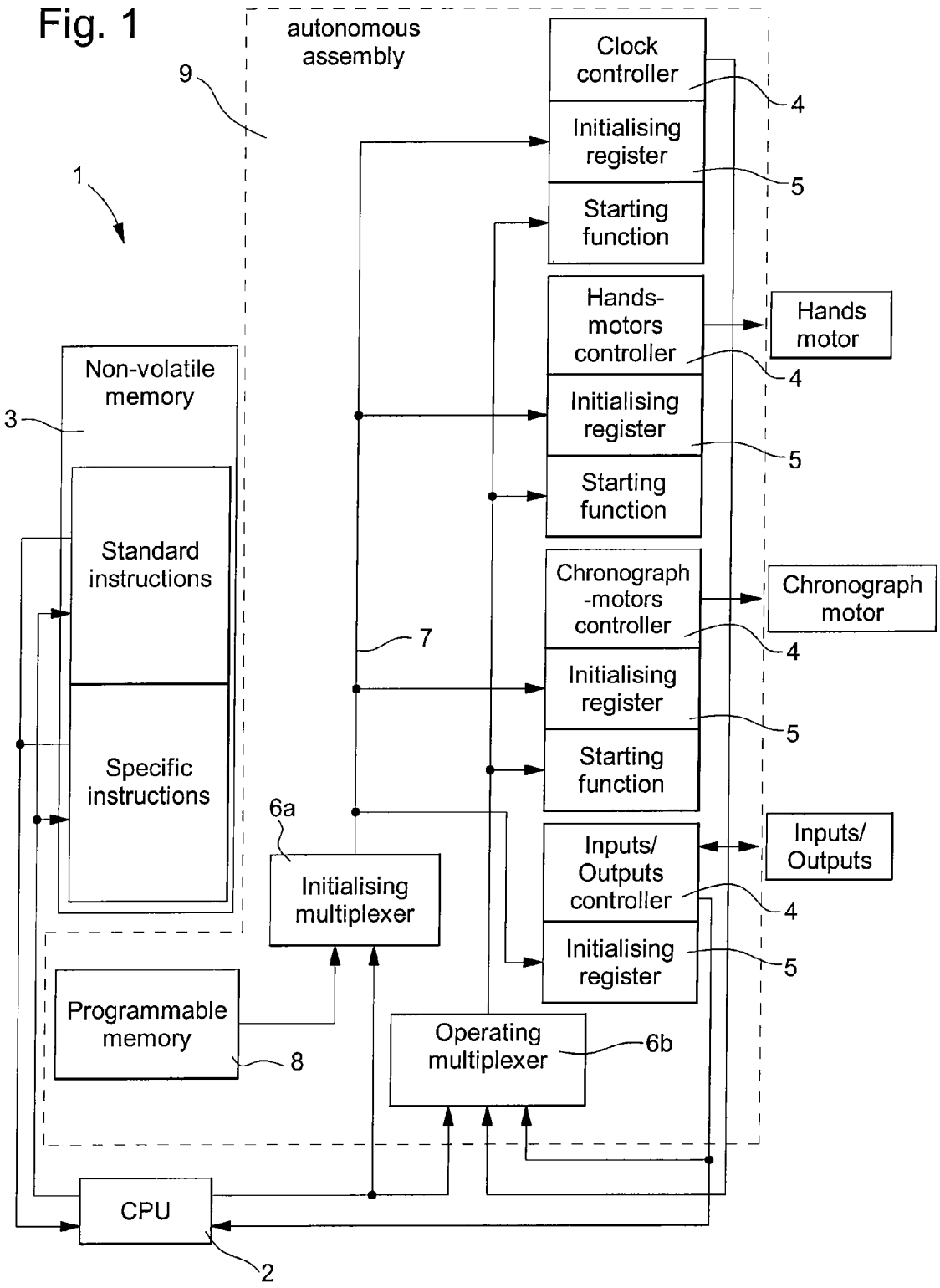
Fig. 1
autonomous assembly
9
1
Clock controller
4
Initialising register
5
Starting function
Hands-motors controller
Hands motor
4
Initialising register
5
Starting function
Non-volatile memory
3
Standard instructions
Specific instructions
Chronograph -motors controller
Chronograph motor
4
7
Initialising register
5
Starting function
6a
Initialising multiplexer
Inputs/ Outputs controller
Inputs/ Outputs
4
Initialising register
5
Programmable memory
8
Operating multiplexer
6b
CPU
2

ELECTRONIC CIRCUIT CONTROLLING THE OPERATION OF PERIPHERAL MEMBERS OF THE WATCH

This application claims priority from European Patent Application No. 07121548.7, filed Nov. 26, 2007, the entire disclosure of which is incorporated herein by reference.

FIELD OF THE INVENTION

This invention concerns generally an electronic circuit for controlling the operation of a watch that has several functions. Various peripheral members perform these functions, each of the peripheral members being controlled by a controller. The electronic circuit includes a processor connected to a non-volatile memory, which contains instructions to be carried out, peripheral member controllers for interacting with the peripheral members of the watch, and connecting means arranged to allow the peripheral member controllers, non-volatile memory and processor to communicate information relating to the operation of the watch to each other.

TECHNICAL BACKGROUND OF THE INVENTION

Electronic watch circuits for controlling the watch are known from the prior art, i.e. for example for counting seconds, rotating the hands or managing the user's manual action on the buttons of the watch. The electronic circuits of the prior art include a processor associated with a non-volatile memory that stores programme lines necessary for the watch to operate, in addition to peripheral member controllers. These peripheral member controllers are responsible for forming the link between the peripheral members of the watch, such as for example the motor/hands assembly, the chain division or other members.

In this type of electronic circuit, management of the watch is entirely under the control of the processor, through which all communications between the various elements take place. For example, if the user switches on the chronograph, by activating the appropriate button, the pressure on the button will cause a state change in the corresponding signal. This state change reaches the processor, which will then process this information to access the memory, search for the corresponding instruction and execute the instruction by ordering the peripheral members concerned to act in accordance with the instruction.

However, controlling a watch in this way raises some problems within the field of horology. In fact, one of the major concerns of the watch industry is to increase the lifetime of the battery of electronic watches. Controlling a watch in accordance with the prior art means that the processor is frequently in operation. For example, simply in order to display the time, the processor has to be switched on every second to increment the time counter and carry out the change in the display system. This necessarily involves non-negligible electrical power consumption, thereby reducing the lifetime of the battery.

Another problem linked to this type of control arises from the fact that the connecting means for transferring data are arranged such that all communications pass through the processor. Thus, each watch circuit is specifically wired in accordance with the functions that it has. This leads to a risk of significant stocks of electronic watch circuits being left over, if the circuits are not as successful as expected.

SUMMARY OF THE INVENTION

The invention concerns an electronic watch circuit that overcomes the aforementioned drawbacks of the prior art, i.e.

high power consumption and lack of flexibility, wherein the object of the circuit is to execute operations independently of the processor and/or the non-volatile memory.

The invention therefore concerns the aforementioned electronic circuit for managing the operation of a watch, characterized in that it further includes initialising means able to act on the peripheral member controllers to initialise the members and enable them to perform operations independently of the processor and/or the non-volatile memory. Thus, in accordance with a first embodiment of the present invention, an electronic circuit for controlling the operation of a watch is provided, wherein the circuit includes (a) a processor connected to a non-volatile memory, which contains instructions to be carried out, (b) peripheral member controllers for interacting with the peripheral members of the watch, and (c) connecting means arranged for enabling the peripheral member controllers, the non-volatile memory and the processor to communicate data relating to the operation of the watch to each other, wherein the electronic watch circuit further includes (d) initialising means able to act on the peripheral member controllers to initialise the controllers by sending data without actions of the processor and enable the controllers to carry out operations independently of the processor and/or the non-volatile memory.

Advantageous embodiments of the electronic circuit are the subject of additional embodiments of the present invention. For instance, in accordance with a second embodiment of the present invention, the first embodiment is modified so that the initialising means consist of a programmable memory that stores configuration data for the peripheral member controllers so that the controllers can be initialised in accordance with the peculiar features of each peripheral member and/or the inputs/outputs of each peripheral member controller with the other elements of the electronic circuit. In accordance with a third embodiment of the present invention, the second embodiment is further modified so that a circuit controller commands the configuration of the peripheral member controllers. In accordance with a fourth embodiment of the present invention, the second embodiment is further modified so that the peripheral member controllers can be configured automatically when the electronic circuit is switched on. In accordance with a fifth embodiment of the present invention, the second embodiment is further modified so that configuration of the peripheral member controllers is controlled in accordance with the value of a bit written into the programmable memory.

In accordance with a sixth embodiment of the present invention, the first embodiment is further modified so that the connecting means include at least one communication bus and at least one multiplexer configured by data from the initialising means and arranged for controlling communications between the various elements of the electronic circuit. In accordance with a seventh embodiment of the present invention, the first embodiment is modified so that the processor is capable of passing from a passive mode to an active mode, in which it can execute instructions following generation of an interruption caused by one of the peripheral members. In accordance with an eighth embodiment of the present invention, the seventh embodiment is further modified so that when an interruption is generated, the non-volatile memory also passes from a passive mode to an active mode in order to communicate with the processor. In accordance with a ninth embodiment of the present invention, the first embodiment is modified so that the non-volatile memory is divided into two zones, including a first zone containing standard application code lines and a second zone containing specific application code lines.

In accordance with a tenth embodiment of the present invention, the first embodiment is modified so that when it starts, its start includes the steps of: i. accessing the initialising means; ii. reading the data stored in the initialising means; and iii. executing configuration instructions stored in the initialising means. In accordance with the start method according to the eleventh embodiment of the present invention, the tenth embodiment is modified so that when the processor passes from a passive mode to an active mode where the processor can execute instructions, the method includes the steps of: iv. receiving an interruption signal from at least one peripheral member of the watch, wherein the interruption signal is transmitted to the processor via the connecting means; v. switching on the processor; vi. executing the instruction associated with the interruption signal, via the processor; and vii. placing the processor in passive mode once the instruction has been executed.

One advantage of the circuit according to the invention is that the initialising means can act on the peripheral member controllers to initialise the members and enable them to perform operations independently of the processor and/or the non-volatile memory. This ensures, firstly, that it is possible for the peripheral members to be autonomous relative to the processor with or without the accompaniment of the non-volatile memory, without, however, excluding the possibility of reintegrating the processor in management of the operation of the watch. Secondly, this reduces electrical power consumption, which passes from 7.6 μA during control in accordance with the prior art to a power consumption of around 400 nA for control in accordance with this invention.

Finally, another advantage of this invention is that it guarantees the flexibility of the electronic watch circuit so that, according to the invention, the number of applications in the circuit is not set rigidly. This thus means that from one manufacturing series to another, there is less need to be concerned about stock problems, since the circuit is sufficiently flexible to allow different applications from those originally envisaged to be implemented and thus the circuit can be used in numerous products.

The invention also concerns a method for initialising an electronic watch circuit so that the circuit can be controlled without the processor and the non-volatile memory, where the code lines encoding the applications are stored, being switched on.

The method is therefore characterized in that the initialising means are accessed, then the data contained therein is read and the instructions are executed, which enables the peripheral member controllers to be initialised.

The advantage of this method arises from the fact that it is only the initialising means that have to be altered in accordance with the applications that one wishes to implement in the watch.

One particular step of the method forms the subject of a twelfth embodiment of the present invention.

BRIEF DESCRIPTION OF THE DRAWINGS

The objects, advantages and features of the electronic watch circuit and the method of activating the same will appear more clearly in the following detailed description of at least one embodiment of the invention given solely by way of non-limiting example and illustrated by the annexed drawing, in which:

FIG. 1 shows schematically the electronic watch circuit according to the invention.

DETAILED DESCRIPTION OF THE INVENTION

In the following description, all those parts of the electronic circuit that are well known to those skilled in this technical field will be described only in a simplified manner. The electronic circuit is mainly intended for operating watch elements or peripheral members.

FIG. 1 shows schematically electronic watch circuit 1 according to this invention. This circuit 1 controls the operation of a watch and includes, in the same chip, a processor 2 that communicates with a non-volatile memory 3, peripheral member controllers 4 that communicate with the peripheral watch members outside electronic circuit 1 and with the interior of the circuit via connecting means 6*a*, 6*b* and 7. These connecting means 6*a*, 6*b* and 7 enable the peripheral member controllers to communicate with each other, but also with processor 2 and consequently also with non-volatile memory 3.

Electronic circuit 1 is powered by a voltage source, typically a battery, whose voltage is preferably 1.55V although a different voltage could be used. Of course, other electrical powering means could be envisaged.

As regards the technology used for non-volatile memory 3, this could be Flash or EEPROM non-volatile memory technology. These non-volatile memories 3 allow data to be rewritten during partial or total reprogramming depending upon the evolution of electronic watch circuit 1 over time.

However, any type of non-volatile memory could be used. The choice of one memory type over another will be depending upon the compactness, capacity, electrical power consumption, efficiency, access and read features of each memory type envisaged.

This non-volatile memory 3 will contain the code lines for the instructions used to operate the watch. These instructions may be divided into two categories: standard instructions and specific instructions. Standard instructions are the watch instructions that are most commonly used or that are permanently integrated in the electronic watch systems. One could cite for example time incrementing instructions, time and date display, or even chronograph functions. Conversely, specific instructions are instructions that are not necessary for the actual operation of the watch or that are not always implemented in watches, such as instructions for controlling a transceiver, instructions controlling an external sensor, instructions controlling meteorological functions, etc. Preferably, non-volatile memory 3 is formed of two distinct zones: a first zone where the standard instructions are written, and a second zone where the specific instructions are written.

The term "peripheral member" is used for the watch systems that are useful for the working of the watch and for performing the functions proposed by the watch. One could cite, for example, as an ever-present peripheral member, the quartz, accompanied by its chain division used for clocking the various elements. It should also be noted that this circuit 1 has only one oscillator for clocking all of the watch elements. Other peripheral members could be the systems driving the hands or the display screen depending upon whether the watch is analogue or digital. One could also cite the inputs/outputs, i.e. the various watch buttons, whereas optional peripheral members could be the systems driving a chronograph or systems controlling any function using a sensor, such as a compass, altimeter or other function.

As can be seen in FIG. 1, the various elements of electronic circuit 1 are connected to each other via connecting means 6*a*, 6*b* and 7. The latter are represented partly in FIG. 1 by 2 multiplexers 6*a* and 6*b*. These multiplexers 6*a* and 6*b* include initialising multiplexer 6*a*, which is used primarily for initialising the initialising registers 5 of peripheral member controllers 4, and operating multiplexer 6*b*, which is used for the flow of data between the various elements when circuit 1 is operating normally.

The two multiplexers 6*a* and 6*b* are connected to the various elements by communication buses 7. The elements connected to each other by multiplexers 6*a* and 6*b* and communication bus 7 include processor 2, which is also capable of communicating with peripheral member controllers 4. This is due to the fact that circuit 1 may either be independent from processor 2 and non-volatile memory or dependent thereon. It should also be noted that other connecting means 6*a*, 6*b* and 7 could be used in electronic watch circuit 1 according to this invention.

As emphasised above, this circuit 1 differs from currently known circuits in that it has initialising means 8, which can configure peripheral member controllers 4 and connecting means 6*a*, 6*b* and 7, i.e. multiplexers 6*a* and 6*b*, so that the peripheral members can operate entirely independently of processor 2 and non-volatile memory 3. These initialising means 8 are shown in FIG. 1 in the form of a programmable memory 8 containing the initialisation data that is supposed to be implemented in initialising registers 5 of peripheral members 4 and the initialisation data for connecting means 6*a* and 6*b*. This programmable memory 8 is connected to initialisation registers 5 of peripheral member controllers 4 via initialising multiplexer 6*a* and a communication bus 7. These initialising means 8, peripheral member controllers 4 and connecting means 6*a*, 6*b* and 7 form the autonomous assembly 9 used to enable the watch to operate without any intervention by processor 2 and non-volatile memory 3.

The initialisation instructions, which are placed in initialising register 5 of peripheral member controllers 4, comprise the following data. The data implemented in the various initialising registers include first of all the peculiar features of the peripheral members as cited above, which do not contribute to reducing the electrical power consumption of circuit 1, i.e. they do not help to make the peripheral members autonomous. The problem is resolved by implementing instructions that configure the inputs/outputs of each peripheral member controller 4.

In fact, each peripheral member controller 4 has a series of inputs/outputs enabling it to communicate with the associated peripheral member, i.e. to receive data from the peripheral member, and also to communicate with processor 2, i.e. to transmit data to processor 2 and to receive data from the processor that then has to be transmitted to the peripheral member. The description that has just been given describes what happens in a prior art circuit. In fact, this is the example of what happens when the chronograph is switched on by pressing on a button. In this example, pressure on the button will cause a state change in the variable concerned, and this state change will then be transmitted to processor 2 via peripheral member controller 4, which controls the various buttons. Afterwards, processor 2 will process this data, i.e. interpret what the state change means and take action accordingly, i.e. carry out the instruction which controls the chronograph and transmit the instruction to the peripheral members concerned, i.e. the hands and the chronograph and watch motor.

The invention differs from the prior art in that, in the example above, the state change of the variable associated with the button that has been activated will be sent directly to the peripheral members so that those members can carry out their function. Thus, this omits one data transfer and processing by processor 2, which saves cycle time and also saves energy since there is no need to switch on processor 2 in order to carry out these tasks.

Consequently, a method for switching on electronic watch circuit 1 and more generally the watch has been developed. At the start, all of the systems are normally switched off, thus initialising registers 5 of peripheral member controllers 4 cannot be initialised. Therefore, electronic circuit 1 of the invention has a circuit controller, which is responsible for switching on circuit 1. In order to do so, the circuit controller will access programmable memory 8 containing the initialisation data, read the data and then transfer the data to initialisation registers 5 of the peripheral member controllers 4 concerned. Once this process has finished, the watch will start to operate.

However, it should be noted that it is not necessarily the circuit controller that gives the instruction for registers 5 of peripheral member controllers 4 to be initialised. Thus, the reading of programmable memory 8 and the subsequent operations could be carried out automatically when the circuit is switched on. Another solution consists in defining a bit in the memory whose value allows either automatic initialisation or initialisation by the circuit controller.

It was stated above that electronic watch circuit 1 had the possibility of using processor 2 in order to execute specific instructions. However, it should be noted that processor 2 could also be switched on to execute standard instructions if necessary. We will therefore explain below the method that enables processor 2 to be used for executing such instructions.

Processor 2 must be able to be switched on again at any time, as soon as an instruction, whether it be a specific or standard instruction, has to be executed by the processor 2. In order to do this, each peripheral member must be able to send an interruption signal to processor 2, via connecting means 6*a*, 6*b* and 7. This interruption signal switches on processor 2 in order to execute the instructions stored in non-volatile memory 3. Thus, as soon as processor 2 receives the interruption signal, the processor alarm is set off and processor 2 then passes from a passive mode to an active mode, in which it can perform tasks. Processor 2 will therefore access the non-volatile memory, read the corresponding instruction and then execute the instruction. Once the instruction has been executed, processor 2 can pass from an active mode to a passive mode, on standby in order to reduce the overall electrical power consumption of electronic watch circuit 1. This embodiment, where an interruption signal is used to enable processor 2 to execute instructions, is preferably used for the execution of specific instructions.

It will be clear that various alterations and/or improvements that are obvious to those skilled in the art could be made to the various embodiments of the invention explained above without departing from the scope of the invention as defined by the annexed claims.

What is claimed is:

1. An electronic circuit for controlling the operation of a watch, wherein the electronic circuit includes:

(a) a processor connected to a non-volatile memory that contains instructions to be carried out;

(b) peripheral member controllers for interacting with peripheral members of the watch;

(c) connecting means arranged for enabling the peripheral member controllers, the non-volatile memory and the processor to communicate data relating to the operation of the watch to each other; and (d) initialising means able to act on the peripheral member controllers to initialise the peripheral member controllers by sending data without actions of the processor and enable the peripheral member controllers to carry out operations independently of the processor, or independently of the non-volatile memory, or independently of the processor and the non-volatile memory.

2. The electronic circuit according to claim 1, wherein the initialising means comprises a programmable memory that stores configuration data for the peripheral member controllers so that the peripheral member controllers can be initialised in accordance with the peculiar features of each peripheral member, or the inputs/outputs of each peripheral member controller with the other elements of the electronic circuit, or in accordance with the peculiar features of each peripheral member and the inputs/outputs of each peripheral member controller with the other elements of the electronic circuit.

3. The electronic circuit according to claim 2, wherein a circuit controller commands the configuration of the peripheral member controllers.

4. The electronic circuit according to claim 2, wherein the peripheral member controllers can be configured automatically when the electronic circuit is switched on.

5. The electronic circuit according to claim 2, wherein configuration of the peripheral member controllers is controlled in accordance with a value of a bit written into said programmable memory.

6. The electronic circuit according to claim 1, wherein the connecting means include at least one communication bus and at least one multiplexer configured by data from the initialising means and arranged for controlling communications between various elements of the electronic circuit.

7. The electronic circuit according to claim 1, wherein the processor is capable of passing from a passive mode to an active mode, in which the processor can execute instructions following generation of an interruption caused by one of the peripheral members.

8. The electronic circuit according to claim 7, wherein when an interruption is generated, the non-volatile memory also passes from a passive mode to an active mode in order to communicate with the processor.

9. The electronic circuit according to claim 1, wherein the non-volatile memory is divided into two zones, including a first zone containing standard application code lines and a second zone containing specific application code lines.

10. A method of starting the electronic circuit according to claim 1, wherein the method includes the steps of:

i. accessing the initialising means;

ii. reading the data stored in the initialising means; and iii. executing configuration instructions stored in the initialising means.

11. The method according to claim 10, wherein when the processor passes from a passive mode to an active mode in which the processor can execute instructions, the method further includes the steps of:

iv. receiving an interruption signal from at least one peripheral member of the watch, wherein the interruption signal is transmitted to the processor via the connecting means;

v. switching on the processor;

vi. executing the instruction associated with the interruption signal, via the processor; and vii. placing the processor in passive mode once the instruction has been executed.

12. The electronic circuit according to claim 1, wherein only one oscillator is used for clocking all of the watch elements.

13. A watch comprising an electronic circuit for controlling operation of the watch, wherein the electronic circuit includes:

(a) a processor connected to a non-volatile memory that contains instructions to be carried out;

(b) peripheral member controllers for interacting with peripheral members of the watch;

(c) connecting means arranged for enabling the peripheral member controllers, the non-volatile memory and the processor to communicate data relating to the operation of the watch to each other; and (d) initialising means able to act on the peripheral member controllers to initialise the peripheral member controllers by sending data without actions of the processor and enable the peripheral member controllers to carry out operations independently of the processor, or independently of the non-volatile memory, or independently of the processor and the non-volatile memory.

14. The electronic circuit according to claim 13, wherein only one oscillator is used for clocking all elements of the watch.

* * * * *